United States Patent [19]

Koshino et al.

[11] 4,057,022

[45] Nov. 8, 1977

[54] VESSEL HAVING A PATTERN-MOLDED BOTTOM, A MANUFACTURING PROCESS THEREFOR

[75] Inventors: Kenji Koshino; Masayasu Itoh, both of Toyota, Japan

[73] Assignee: Toyota Jidosha Kogyo Kabushiki Kaisha, Japan

[21] Appl. No.: 691,783

[22] Filed: June 1, 1976

[51] Int. Cl.[2] ..... B21D 51/00; B21D 22/00

[52] U.S. Cl. ..... 113/120 G; 72/348; 72/379; 113/116 Z

[58] Field of Search ..... 72/348, 349, 350, 377, 72/379; 113/116 V, 116 Y, 116 Z, 120 W, 120 R, 120 C, 120 G

[56] References Cited

U.S. PATENT DOCUMENTS

| | | | |
|---|---|---|---|
| 1,826,559 | 10/1931 | Meier | 72/350 X |
| 1,974,891 | 9/1934 | Carvalho | 72/348 |
| 2,429,376 | 10/1947 | Stagmeier | 72/348 X |
| 2,899,922 | 8/1959 | Wheeler | 113/120 W |
| 3,144,974 | 8/1964 | Eichner | 72/348 X |
| 3,550,421 | 12/1970 | Stobel | 72/350 X |

*Primary Examiner*—Leon Gilden

*Attorney, Agent, or Firm*—Oblon, Fisher, Spivak, McClelland & Maier

[57] ABSTRACT

A vessel having a pattern-molded bottom formed by a process of molding a pattern on the part of a flat blank which is to become the bottom of a vessel, holding the rest of the blank in such a manner that the molded pattern may not be affected by subsequent working of the part of the blank other than the pattern-molded part, and then forming the side wall of the vessel by drawing the rest of the blank.

6 Claims, 7 Drawing Figures

VESSEL HAVING A PATTERN-MOLDED BOTTOM, A MANUFACTURING PROCESS THEREFOR

BACKGROUND OF THE INVENTION

1. Field of the Invention

The present invention relates generally to a vessel having a bottom with a louvered, punched or embossed pattern and to a manufacturing process thereof.

2. Description of the Prior Art

In the conventional practice of manufacturing a vessel having a bottom with a louvered, punched or embossed pattern, a flat blank of specified dimensions is drawn to yield an interim product of vessel form, a louvered pattern is molded on such interim product, and the final product is then obtained by cutting and other steps.

In this conventional practice, however, in which a louvered or other pattern is molded after drawing a flat blank, the side wall of the vessel restricts the profile of the mold for producing the pattern, resulting in a high cost of production, and moreover, the maintenance of the mold is inconvenienced.

When the pattern is to cover nearly the whole area of the bottom of the vessel, on account of a heavy work load and the profile and maintenance of the mold, the molding of the pattern is often done in several steps, which is inefficient and liable to increase the manufacturing cost of the vessel.

SUMMARY OF THE INVENTION

The primary object of the present invention therefore is to provide a process of manufacturing a vessel having a pattern-molded bottom, characterized by molding a pattern on the vessel bottom before the side wall forming stage, thereby eliminating the possibility of the side wall obstructing the molding of a pattern and various limitations in the size, profile, and maintenance of the mold and the number of steps needed for molding the pattern.

Another object of the present invention is to provide a process of forming the side wall of a vessel after holding a non-patterned part of the vessel blank in such a manner that the drawing of the side wall can be done without affecting the pattern molded on the part to become the vessel bottom.

Yet another object of the present invention is to provide an improved vessel with a pattern molded bottom.

The foregoing and other objects are achieved according to the present invention by a method which comprises molding a pattern on a central part of a flat blank, holding the blank about a part thereof outside said pattern between centrally recessed clamping planes, said recesses receiving said molded pattern whereby damage to the pattern molded on the blank is prevented, and drawing the side wall of the vessel by holding the extreme outside of said blank between opposing movable clamping planes without producing a crimp in said side wall.

BRIEF DESCRIPTION OF THE DRAWINGS

The foregoing and other objects, features and attendant advantages of the present invention will be more fully appreciated as the same becomes better understood from the following detailed description of a preferred embodiment of the invention, as illustrated in the accompanying drawings, in which.

DESCRIPTION OF THE PREFERRED EMBODIMENTS

Figure 1:
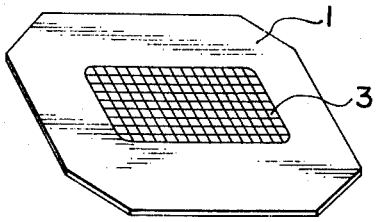
FIG. 1 is a perspective view of a vessel blank in which the part to become the bottom has a pattern molded thereon before the side wall is drawn.
Figure 2:
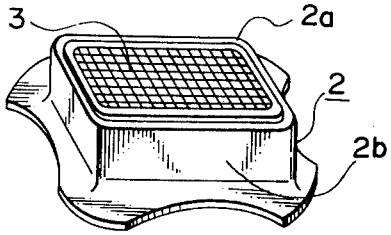
FIG. 2 is a perspective view of a finished vessel with a molded pattern on its bottom.
Figure 3:
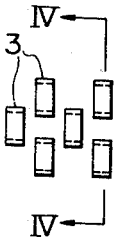
FIG. 3 is a plan view illustrating a pattern to be molded on the vessel bottom.
Figure 4:
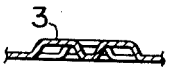
FIG. 4 is a section view along the line IV—IV of FIG. 3.

Referring now to the drawings and more particularly to FIGS. 1 and 2, first a louvered, punched or embossed pattern 3 is molded appropriately on the central part of a flat vessel blank 1 of specified dimensions which is to become the bottom 2*a* of a finished vessel 2. FIGS. 3 and 4 illustrate a louvered pattern as an example.

Figure 5:
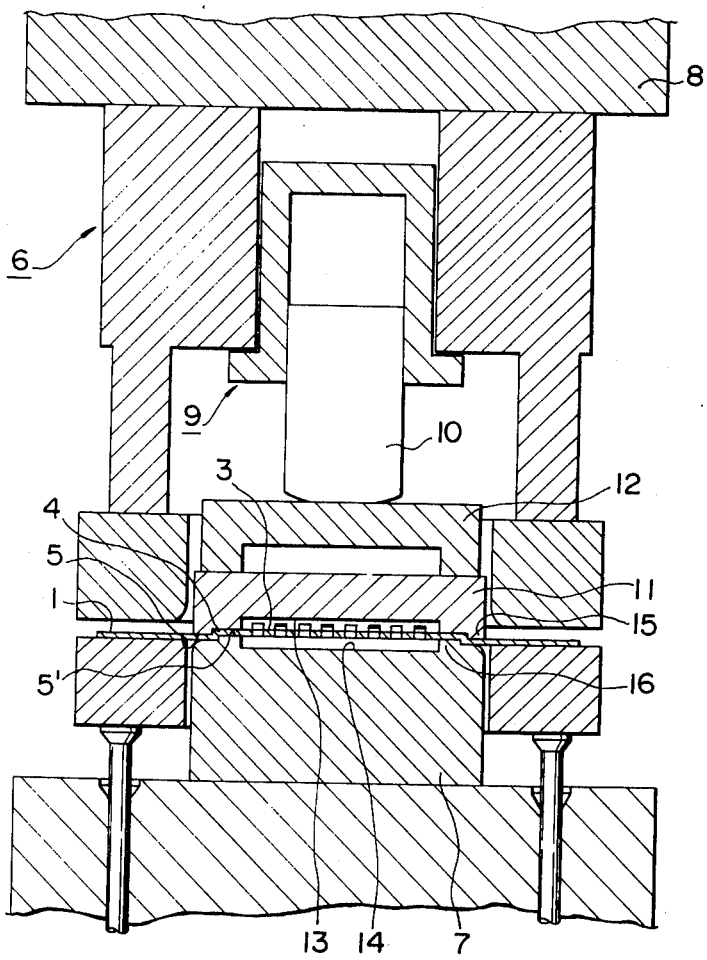
FIG. 5 is a section view showing a vessel blank held between clamping planes when the blank has a pattern molded on its part to become the vessel bottom and is then set on a press for manufacturing a vessel according to the present invention.
Figure 6:
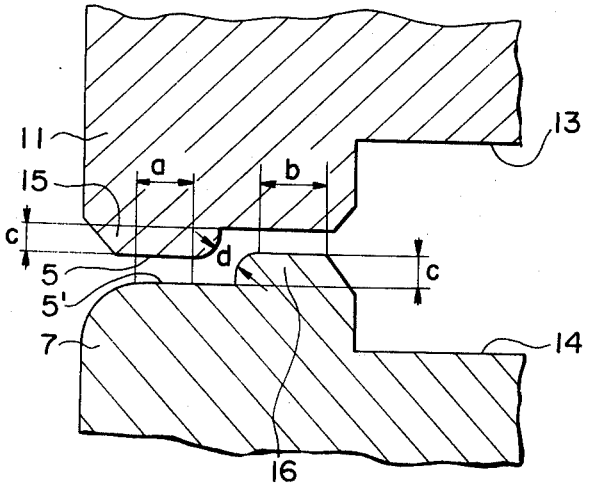
FIG. 6 is an enlarged section view showing the clamping planes of FIG. 5.

Next, referring to FIG. 5, the external part of the blank 1 outside of the pattern 3 is held between clamping planes 5, 5′ which are at least partially parallel to the central part of said blank 1. The blank 1, with a pattern 3 molded thereon, is set at a specified position on a punch 7 of a press 6. A vertically movable table 8 is then lowered to lower a rod 10 in a cylinder 9 of the table 8. At the tip of the rod 10 there is attached a mold 12 which transmits a load to a cushion pad 11 facing the punch 7. As the result of the table 8 and the rod 10 being lowered, first the cushion pad 11 is pressed against the blank 1. The bottom surface of the cushion pad 11 and the top surface of the punch 7 constitute the clamping planes 5, 5′ and the external part of the blank 1 outside the part with the pattern 3 molded thereon is held between these planes 5, 5′. These clamping planes 5, 5′ are centrally recessed as at 13, 14 so that the pattern 3 three-dimensionally molded on the blank 1 may not be injured, and on the periphery of the planes 5, 5′ are provided projections 15, 16 so that the clamped area 4 of the blank with the pattern 3 may be securely held. As shown in detail in FIG. 6, the projections 15, 16 are mutually staggered in position. Each projection is provided with parallel portions 2.5–3.5 times as thick as the blank 1 so that an adequate clamping force can be gained. Meanwhile, to prevent a shift of the blank 1, the extent of each projection is set to equal 0.7–1.3 times that thickness of the blank 1. Further the gap *d* between the steps 15, 16 of the press is set to equal 1.0–1.5 times the thickness of the blank 1.

Thus, when the cushion pad 11 is pressed against the vessel blank 1, the blank 1 has its periphery bent by the recesses 13, 14 and the projections 15, 16 without the pattern 3 being injured. Accordingly, the clamped area 4 can be securely held between the cushion pad 11 and the punch 7.

Next the drawing is done to form the vessel side wall 2*b* out of the external part of the blank 1 outside of the clamped area 4 in the state of the clamped area 4 being securely held between the clamping planes 5, 5′. For the purpose of preventing crimping, this drawing is done by holding the blank between two planes 17, 17' which are parallel to the part which becomes the vessel bottom and are movable at right angles to such part.

Figure 7:
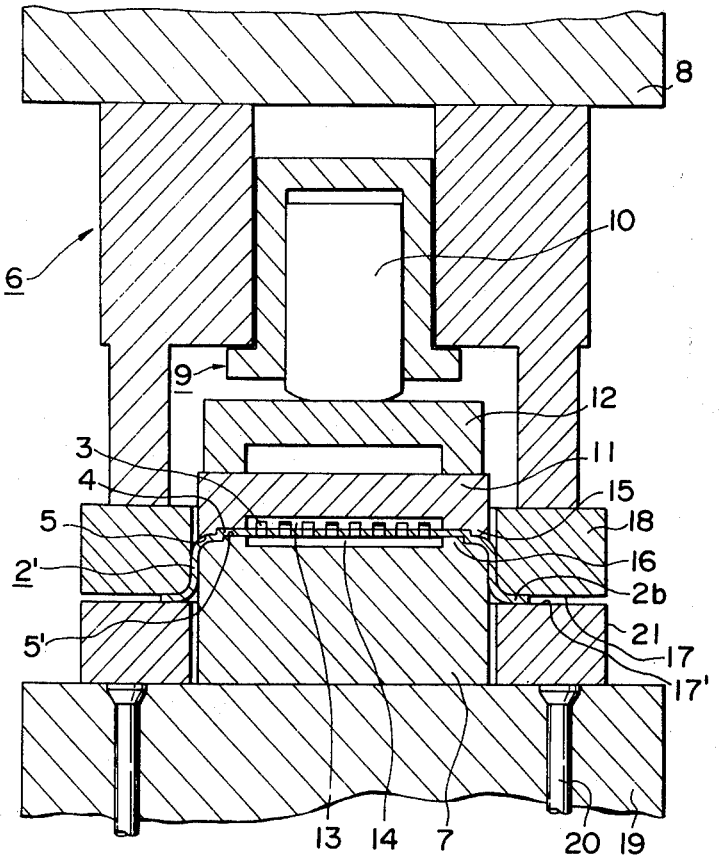
FIG. 7 is a section view showing the drawing of the vessel side wall in the press of FIG. 5.

FIG. 7 illustrates the drawing as done by the press 6. In FIG. 7, the drawing is done by lowering the table 8 with the downward pressure of the rod 10 being kept constant on the periphery of the vessel blank 1, i.e., the part to become the side wall 2*b* of the vessel 2 being held between a die 18 integrated with the table 8 and a crimp-suppressor 21 supported on the stand 19 by a vertically movable cushion pin 20, whereby the bottom surface of the die 18 and the top surface of the crimp suppressor 21 constitute the clamping planes 17, 17'.

Thus, a semi-finished product 2', as illlustrated in FIG. 7, is obtained and, to prevent deformation of this semi-finished product 2', the table 8 is raised with a constant pressure being applied to the rod 10. Then the rod 10 is raised, the cushion pad 11 is raised, and the semi-finished product 2' is taken off. Thereafter, the product is finished into a vessel by cutting and other steps to provide a vessel as configured, for example, in FIG. 2.

As described above, according to the present invention, in which a flat blank 1 has a louvered, punched or embossed pattern 3 molded thereon and thereafter the external clamped part 4 of the blank outside of the pattern is securely clamped to produce a vessel 2 by drawing a vessel side wall 2*b,* there is no limitation in the profile of the mold to produce the pattern 3 or in the working load. Therefore, a cheap mold can be employed, and even when a pattern is to be molded over the whole area of the vessel bottom, the working can be done at one time, thereby making it possible to manufacture the vessel 2 at low cost. Besides, various other objects, as described above, can be attained by the present invention.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process of manufacturing a vessel with a pattern-molded bottom, said process being characterized by the following steps:

molding a pattern on adequate area of a flat blank in the part thereof to become the vessel bottom;

clamping an external part of said blank only outside of said molded pattern; and forming the side wall of the vessel by drawing a part outside the clamped part of said blank while said clamping is maintained.

2. The process of claim 1, wherein the pattern molded on the vessel bottom is one of a louvered, punched and embossed one.

3. The process of claim 1, wherein said vessel blank is held between two clamping planes with staggered projections.

4. The process of claim 3, wherein said vessel blank is held between two clamping planes with parallel portions having 2.5–3.5 times the thickness of said blank and projection length 0.7–1.3 times the thickness of said blank.

5. The process of claim 1, wherein said vessel blank is held between two clamping planes each of which are provided with a recess which faces the pattern-molded area of said blank.

6. The process of claim 1, wherein the drawing of the vessel side wall is done while the outside portion of said blank is being held between two clamping planes which are parallel to said blank area and are movable at right angles thereto.

* * * * *